US011180708B2

(12) United States Patent
Wang et al.

(10) Patent No.: US 11,180,708 B2
(45) Date of Patent: Nov. 23, 2021

(54) METHOD FOR USING COLD ROLLING MAGNETIC FILTRATION WASTE

(71) Applicant: BAOSHAN IRON & STEEL CO., LTD., Shanghai (CN)

(72) Inventors: Kangjian Wang, Shanghai (CN); Peilei Qu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 16/960,132

(22) PCT Filed: Jan. 11, 2019

(86) PCT No.: PCT/CN2019/071330
§ 371 (c)(1),
(2) Date: Jul. 6, 2020

(87) PCT Pub. No.: WO2019/137469
PCT Pub. Date: Jul. 18, 2019

(65) Prior Publication Data

US 2021/0071100 A1 Mar. 11, 2021

(30) Foreign Application Priority Data

Jan. 9, 2018 (CN) ..... 201810017342.2

(51) Int. Cl.
*C10L 5/48* (2006.01)
*C10L 9/10* (2006.01)

(52) U.S. Cl.
CPC *C10L 5/48* (2013.01); *C10L 9/10* (2013.01); *C10L 2200/0461* (2013.01)

(58) Field of Classification Search
CPC ..... C10L 5/48; C10L 9/10; C10L 2200/0461
See application file for complete search history.

(56) References Cited

U.S. PATENT DOCUMENTS 5,803,894 A 9/1998 Kao et al.

FOREIGN PATENT DOCUMENTS

CN 102827665 * 12/2012
CN 104479794 4/2015
(Continued)

OTHER PUBLICATIONS

International Search Report and Written Opinion dated Apr. 1, 2019 for PCT Patent Application No. PCT/CN2019/071330.

*Primary Examiner* — Cephia D Toomer
(74) *Attorney, Agent, or Firm* — Lei Fang; Smith Tempel Blaha LLC

(57) ABSTRACT

Disclosed is a method for using cold rolling magnetic filtration waste, comprising using the cold rolling magnetic filtration waste as a fluxing agent for a high-ash-fusion coal so as to achieve the technical requirements of a high melting point coal in dry coal powder gasification and liquid slagging. The cold rolling magnetic filtration waste contains solid particulates with very fine particles (iron-containing particles mainly produced by friction), and the surface thereof has a cold rolling oil attached thereto, and same reacts with other aluminosilicates in coal ash at a high temperature to produce low temperature eutectic compounds such as fayalite ($Fe_2SiO_4$) and hercynite ($Fe_2Al_2O_4$). The fluxing agent has characteristics such as having fine particles, being free of inorganic mineral substances, having an effective ingredient in a high content, operation thereof being simple, and being free of pollution.

10 Claims, 1 Drawing Sheet

(56) References Cited

FOREIGN PATENT DOCUMENTS

| | | |
|---|---|---|
| CN | 104569283 | 4/2015 |
| CN | 105199811 | 12/2015 |
| CN | 105400570 | 3/2016 |
| CN | 105542901 | 5/2016 |

* cited by examiner

METHOD FOR USING COLD ROLLING MAGNETIC FILTRATION WASTE

CROSS-REFERENCE TO RELATED APPLICATIONS

This application is a 371 U.S. National Phase of PCT International Application No. PCT/CN2019/071330 filed on Jan. 11, 2019, which claims benefit and priority to Chinese patent application no. 201810017342.2 filed on Jan. 9, 2018, the contents of both are incorporated by reference herein in their entireties.

TECHNICAL FIELD

The present disclosure relates to a method for utilizing cold-rolling magnetic filtration waste, and pertains to the technical field of solid waste recycling.

BACKGROUND ART

In modern production with a cold rolling mill, in light of rolling efficiency, pass percent, output and manufacturing cost, an emulsion is generally used for lubrication in the production. Due to friction at high temperature and high pressure (such as 200° C. and 650 MPa) in the cold rolling production process, the emulsion may contain a large amount of fine iron powder generated by the friction and wear of the rollers and strip steel. If the fine iron powder is left to be adsorbed on the strip steel surface, the surface quality of the strip steel may be disqualified. Hence, it is necessary to use a magnetic filtration device to remove the fine iron powder from the emulsion during the production process. In this process, a large amount of rolling oil and water will be removed along with the iron powder, forming cold-rolling magnetic filtration waste comprising the emulsion and the fine iron powder. Due to its chemical property of flammability, this kind of matter is hazardous chemical waste that requires special treatment. However, because of the lack of effective treating means in practice, cold-rolling magnetic filtration waste is usually treated by landfill or incineration. These treatment methods not only cause environmental pollution, but also discard the fine iron powder and cold-rolling emulsion, resulting in waste of resources.

After search in the related technical field of cold-rolling emulsion, the following main treatment methods for this magnetic filtration waste have been found:

CN201210076105.6 (Method For Recovering Iron Powder From Magnetic Filtrate In Cold Rolling Plant) mainly proposes a process including: rinsing rolling oil with a cleaning agent, washing iron powder with ultrasonic wave, and finally drying to obtain iron powder originated from friction in rolling. In principle, this process can separate the rolling oil from the iron powder. However, after the treatment, a large amount of cleaning wastewater rich in rolling oil will be obtained, which requires subsequent further treatment. Hence, this process will still cause environmental pollution problems, and it is difficult to be fully applied.

CN200410012152.X (Method For Recovering Iron Nanopowder From Cold-Rolling Emulsion) proposes another similar technical process for treating magnetic filtration product, the main point of which lies in optimization of a cleaning agent to obtain a highly efficient cleaning formulation with strong degreasing ability. Rolling oil and iron powder are fully washed with this cleaning formulation, and then the iron powder is separated using centrifugal separation technology. Similar to that described in the above patent application, utilization of this technical process also requires treatment of the oil-containing wastewater, which causes problems in environmental protection. This technical process has no practicality in large-scale industrial production.

CN201410770205.8 (Test Method For Recovering Iron Oxide Powder And Waste Oil From Steel Rolling Emulsion Sludge) proposes another process for treating cold-rolling magnetic filtration waste, wherein such waste is heated and centrifuged to remove rolling oil and water by evaporation, and obtain an iron powder material that is left over. Then, the resulting iron oxide powder is fired in a carbon tube furnace at a high temperature, and ground to obtain the recovered iron oxide powder. This process requires multiple heating and high-temperature firing during the implementation of the process, and high energy consumption is needed to obtain the final iron oxide product. Hence, the overall economy of the process is difficult to guarantee.

Based on the above search results, it can be seen that the existing processes are immature and complicated in treatment of cold-rolling magnetic filtration waste, and cannot avert generation of secondary pollutants such as waste water and exhaust gas. Meanwhile, the economy of the processes cannot be guaranteed. Thus, there are many technical difficulties in their practical application.

At the same time, China's coal resources are relatively abundant, and there is an urgent need for a technology to convert coal in an efficient and clean way. As a typical representative, the large-scale coal gasification technology has been employed in such fields as gas production, chemical synthesis and the like. The most representative gasification technology today is the entrained-flow bed gasification technology, such as the processes of Shell, GSP, Texaco and the like, which all utilize liquid slag tapping. To this end, the ash melting property of raw coal is on the top priority of the issues to be considered and addressed. It is an essential condition for the ash in the gasified raw coal to melt at the gasification temperature. According to incomplete statistics, coal having a high ash melting point of at least 1400° C. accounts for at least 50% of China's annual coal production. For this reason, a problem to be solved urgently is how to reduce the ash melting point of high-ash-melting-point coal as a gasification raw material to make it suitable for efficient and clean coal conversion technologies. For high-ash-melting-point coal, the fluxes used in industry currently are mainly ores and their composites. On the one hand, as a flux needs to be mixed uniformly with raw coal, an ore needs to be crushed into fine particles before it's used as a flux. This entails consumption of a lot of energy and leads to equipment wear. On the other hand, in order to save cost, the effective component of a low grade ore is usually used as a flux. The co-introduction of ineffective components wastes part of the energy and equipment capacity during the coal gasification process, and also wastes a lot of useful ore resources.

SUMMARY

The technical problem to be solved by the present disclosure is to provide a method for making use of cold-rolling magnetic filtration waste, and a flux for reducing the melting point of high-ash-melting-point coal.

The present invention is realized by the following technical solution:

A method for utilizing cold-rolling magnetic filtration waste, including the following step:

using cold-rolling magnetic filtration waste for a flux, wherein the waste is mixed with a coal powder matrix to obtain the flux.

In a preferred embodiment, a weight ratio of the cold-rolling magnetic filtration waste to the coal powder matrix is from 1:1 to 1:5.

In a preferred embodiment, the cold-rolling magnetic filtration waste comprises a solid particulate matter and rolling oil adsorbed on a surface of the solid particulate matter, wherein the solid particulate matter has an average particle diameter of less than 5 μm, wherein the solid particulate matter comprises iron-containing particles generated by friction.

In a preferred embodiment, a mass fraction of the rolling oil in the cold-rolling magnetic filtration waste is 40-80%.

In a preferred embodiment, the rolling oil consists of lubricating base oil and an additive.

In a preferred embodiment, the coal powder is high-ash-melting-point coal having an ash melting point of not less than 1450° C.

In a preferred embodiment, after the cold-rolling magnetic filtration waste is mixed with the coal powder, the mass of the solid particulate matter is from 0.5 to 5% based on the mass of coal ash in the coal powder.

In a preferred embodiment, the mass of the solid particulate matter is from 1 to 3% based on the mass of the coal ash in the coal powder.

The present disclosure has the following beneficial effects in comparison with the prior art:

1. Because the friction-born iron powder particles in the cold-rolling magnetic filtration waste are extremely fine, far smaller than the particle size of the powder coal, they only need to be mixed uniformly without further crushing, thereby exempting energy consumption for crushing and reducing equipment wear.

2. The cold-rolling magnetic filtration waste does not contain inorganic minerals, and the components of the friction-born fine iron powder brought in are metal and its oxides. The iron content is high. Thus, the content of the active components in the flux is high, and no ineffective component is introduced.

3. The entrained cold rolling oil adsorbed on the metal surface may act as a raw material for gasification and provide heat. Sulfur and nitrogen compounds formed from the heteroatoms in the cold rolling oil can be removed by the common engineering units for post-treatment of synthesis gas from powder coal gasification without environmental pollution.

DESCRIPTION OF THE DRAWINGS

By reading the detailed description of the non-limiting Examples with reference to the following drawings, other features, objects, and advantages of the present disclosure will become more apparent.

DETAILED DESCRIPTION

Figure 1:
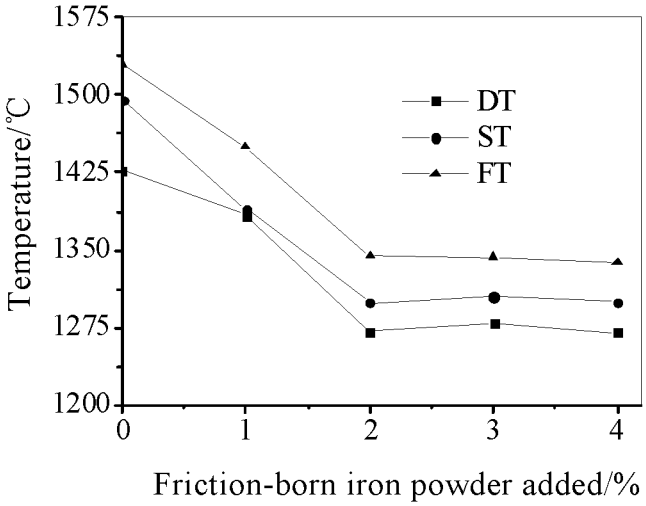
FIG. 1 shows the influence of the flux content on the characteristic melting temperatures of coal sample A.

The present disclosure will be illustrated in detail with reference to the following specific Examples. The following Examples will help those skilled in the art to further understand the present disclosure, but do not limit the present disclosure in any way. It should be noted that, for those skilled in the art, variations and modifications can be made without departing from the concept of the present disclosure. They all fall in the protection scope of the present disclosure.

Example 1

Finely ground high-ash-melting-point raw coal (having a particle size of less than 0.2 mm) was mixed uniformly with cold-rolling magnetic filtration waste in a certain ratio. The solid content of the cold-rolling magnetic filtration waste was 0.5%-5% of the mass of the coal ash in the raw coal sample. The mixed sample was placed in a porcelain boat and then put in a muffle furnace. After incineration at 850° C. for a certain period of time, the sample was taken out for rapid cooling. Subsequently, it was put in a vacuum drying oven to dry at 105° C. for 36 h. Then, it was sealed for later use. As such, an ash sample was prepared. For the melting property of the coal ash, a smart ash melting point detector was used to measure the melting temperature of the ash in a weakly reducing atmosphere using an ash cone method according to GB/T219-1996.

The basic properties of the coal used in Example 1 are listed in Tables 1 to 4. As can be seen from Tables 3 and 4, because the $SiO_2$ and $Al_2O_3$ contents in the ash components were all 35% or higher, the ash melting temperatures were high. The ash melt flow temperatures of the two selected coal samples were greater than 1500° C. According to MT/T853.2 "Grading Criteria For Coal Ash Flowability", they were high flow temperature ash, and did not meet the requirements of liquid slag tapping furnaces for dry coal powder entrained-flow bed gasification processes (FT<1450° C., Shell gasification furnace coal FT<1380° C.).

TABLE 1

Industrial analysis of coal samples, %

| Coal sample | Moisture, $M_{ad}$ | Ash, $A_d$ | Volatiles, $V_{daf}$ | Fixed carbon, $FC_d$ |
|---|---|---|---|---|
| A | 1.82 | 10.60 | 7.19 | 81.5 |
| B | 1.40 | 22.04 | 11.82 | 68.10 |

TABLE 2

Elemental analysis of coal samples, %

| Coal sample | Carbon | Hydrogen | Nitrogen | Sulfur |
|---|---|---|---|---|
| A | 92.17 | 3.14 | 1.07 | 0.46 |
| B | 74.21 | 3.04 | 0.56 | 1.07 |

TABLE 3

Coal ash composition of coal samples, %

| Coal sample | $SiO_2$ | $Al_2O_3$ | CaO | $Fe_2O_3$ | MgO | $Na_2O$ | $TiO_2$ | $SO_3$ |
|---|---|---|---|---|---|---|---|---|
| A | 41.0 | 41.2 | 4.29 | 4.28 | 0.61 | 0.93 | 2.65 | 2.41 |
| B | 45.2 | 36.0 | 5.59 | 4.96 | 0.85 | 0.34 | 1.98 | 2.90 |

TABLE 4

| Coal ash melting temperature, ° C. | | | |
|---|---|---|---|
| Coal sample | Deformation temperature, DT | Softening temperature, ST | Flow Temperature, FT |
| A | 1428 | 1495 | 1530 |
| B | 1412 | 1489 | 1510 |

In Example 1, the raw coal sample was used as the powder coal matrix, and the cold-rolling magnetic filtration waste was used as the flux. Four coal ash melting temperature tests were conducted after adding different proportions of the flux. The addition scheme is shown in Table 5. The addition condition was a ratio of the iron powder content in the cold-rolling magnetic filtration waste to the amount of the coal ash sample in the coal sample.

Figure 2:
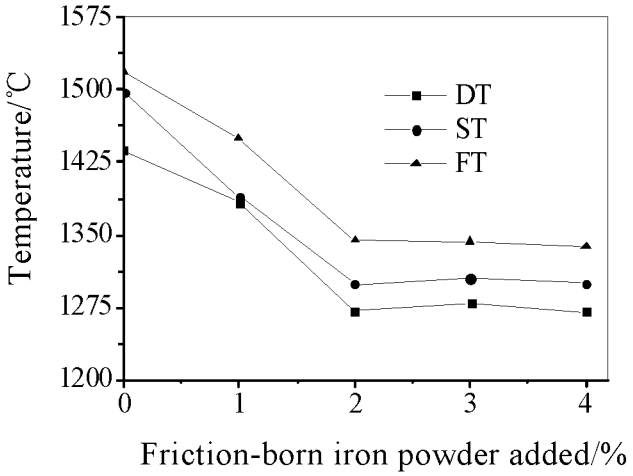
FIG. 2 shows the influence of the flux content on the characteristic melting temperatures of coal sample B.

FIGS. 1 and 2 depict curves respectively showing the influence of the measured flux addition amount (the ratio of the iron powder content in the cold-rolling magnetic filtration waste to the coal ash sample amount in the coal sample) on the characteristic ash melting temperatures of coal sample A and coal sample B. As can be seen from FIGS. 1 and 2, when the cold-rolling magnetic filtration waste was added as a flux, and the friction-born iron powder contained therein was added in an amount that was increased to 2% of the total coal ash amount, the deformation temperature (DT), softening temperature (ST) and the flow temperature (FT) of the coal sample showed a similar trend of change, i.e. decreased obviously; particularly, decreased by about 200° C. However, when the addition amount was further increased, the characteristic temperatures of the coal sample substantially did not change. When the addition amount reached 2%, the ash flow temperature of raw coal sample A decreased from 1530° C. to 1344° C., and the ash flow temperature of raw coal sample B decreased from 1510° C. to 1340° C., both less than 1350° C., thereby both meeting the technical requirements of dry coal powder gasification and liquid slag tapping of Shell gasifiers.

In summary, the above Examples are only preferred embodiments of the present disclosure, and are not intended to limit the scope of the present disclosure in implementation. Any equivalent variations and modifications based on the shapes, structures, features and spirit described in the scope of the claims of the present disclosure should be included in the scope of the claims of the present disclosure.

What is claimed is:

1. A method for reducing an ash flow temperature of a high-ash-melting-point coal having an ash melting point of not less than 1450° C., comprising mixing a cold-rolling magnetic filtration waste with the high-ash-melting-point coal by using the cold-rolling magnetic filtration waste as a flux and the high-ash-melting-point coal as a matrix.

2. The method of claim 1, wherein a weight ratio of the cold-rolling magnetic filtration waste to the matrix is from 1:1 to 1:5.

3. The method of claim 1, wherein the cold-rolling magnetic filtration waste comprises a solid particulate matter and rolling oil adsorbed on a surface of the solid particulate matter, wherein the solid particulate matter has an average particle diameter of less than 5 μm, wherein the solid particulate matter comprises iron-containing particles generated by friction.

4. The method of claim 3, wherein a mass fraction of the rolling oil in the cold-rolling magnetic filtration waste is 40-80%.

5. The method of claim 4, wherein the rolling oil consists of lubricating base oil and an additive.

6. The method of claim 3, wherein after the cold-rolling magnetic filtration waste is mixed with the coal powder, the mass of the solid particulate matter is from 0.5 to 5% based on the mass of coal ash in the coal powder.

7. The method of claim 6, wherein the mass of the solid particulate matter is from 1 to 3% based on the mass of the coal ash in the coal powder.

8. The method of claim 2, wherein the cold-rolling magnetic filtration waste comprises a solid particulate matter and rolling oil adsorbed on a surface of the solid particulate matter, wherein the solid particulate matter has an average particle diameter of less than 5 μm, wherein the solid particulate matter comprises iron-containing particles generated by friction.

9. The method of claim 8, wherein a mass fraction of the rolling oil in the cold-rolling magnetic filtration waste is 40-80%.

10. The method of claim 9, wherein the rolling oil consists of lubricating base oil and an additive.

* * * * *